US005205454A

United States Patent [19]

Schutz et al.

[11] Patent Number: 5,205,454

[45] Date of Patent: Apr. 27, 1993

[54] PAPER TOWEL DISPENSING SYSTEM

[75] Inventors: Rudolph W. Schutz, Walnut Creek; Lawrence E. Weinert, Antioch, both of Calif.

[73] Assignee: James River II, Inc., Oakland, Calif.

[21] Appl. No.: 884,923

[22] Filed: May 18, 1992

[51] Int. Cl.[5] ..... B65H 35/10

[52] U.S. Cl. ..... 225/1; 225/106; 206/409; 242/55.2

[58] Field of Search ..... 225/1, 2, 4, 5, 100, 225/106; 206/409; 221/25, 26, 27; 242/55.2, 55.53; 226/127, 128, 129

[56] References Cited

U.S. PATENT DOCUMENTS

| | | | |
|---|---|---|---|
| 405,412 | 6/1889 | Hicks | 225/106 X |
| 714,652 | 11/1902 | Davis . | |
| 906,110 | 12/1908 | Covington | 226/127 |
| 1,553,954 | 9/1925 | Parsons | 221/26 |
| 1,975,414 | 10/1934 | Wade | 226/129 X |
| 2,322,531 | 6/1943 | Maltby et al. | 226/127 X |
| 2,886,226 | 5/1959 | Batlas et al. | 225/106 |
| 3,467,250 | 9/1969 | D'Elia et al. . | |
| 3,575,328 | 4/1971 | Jespersen et al. | 225/2 |
| 3,583,558 | 6/1971 | Davis | 206/58 |
| 3,770,172 | 11/1973 | Nystrand et al. | 225/106 X |
| 4,121,004 | 10/1978 | Ehrlund | 206/390 X |
| 4,199,090 | 4/1980 | Reed | 225/13 |
| 4,284,221 | 8/1981 | Nagel et al. | 225/106 X |
| 4,432,482 | 2/1984 | Beausoleil | 242/55.53 X |
| 4,646,364 | 3/1987 | O'Larey . | |
| 4,884,719 | 12/1989 | Levine | 221/25 |
| 5,041,317 | 8/1991 | Greyvenstein | 206/390 X |

*Primary Examiner*—Frank T. Yost
*Assistant Examiner*—Rinaldi Rada
*Attorney, Agent, or Firm*—Thomas R. Lampe

[57] ABSTRACT

A system for dispensing individual sheet material segments from a roll of sheet material. The sheet material is separated into individual segments by perforated tear lines which are shaped to incrementally pass through a nip formed by nip rollers due to a pulling force exerted on an end-most segment by a user. A drag force opposed to the pulling force is exerted on the sheet material by the nip rollers so that the tear line tears as it passes through the nip. Tearing along the perforated tear line is not completed until a portion of an adjacent segment is presented for pulling by a subsequent user.

13 Claims, 3 Drawing Sheets

PAPER TOWEL DISPENSING SYSTEM

TECHNICAL FIELD

This invention relates to a system for dispensing individual sheet material segments from a roll of sheet material. The invention has particular application to the manual dispensing of individual paper towels from a roll of such towels interconnected by perforated tear lines.

BACKGROUND ART

Many dispenser devices exist or are known in the prior art for dispensing paper toweling. Commonly, dispensing is from a roll of toweling, which may be either perforated or non-perforated, the dispenser operative to form tear lines at spaced locations in the toweling whereby individual towels are manually removed from the remainder of the toweling.

The use of perforated tear lines in rolls of sheet material such as paper toweling is a widely employed, well known expedient per se. A search of the prior art located the following United States patents which may be considered representative of the state of the prior art: U.S. Pat. No. 5,041,317, issued Aug. 20, 1991,U.S. Pat. No. 3,575,328, issued Apr. 20, 1971, U.S. Pat. No. 4,646,364, issued Mar. 3, 1987, U.S. Pat. No. 3,467,250, issued Sep. 16, 1969, U.S. Pat. No. 4,199,090, issued Apr. 22, 1980, U.S. Pat. No. 714,652, issued Nov. 25, 1902, U.S. Pat. No. 4,121,004, issued Oct. 17, 1978, and U.S. Pat. No. 3,583,558, issued Jun. 8, 1971.

DISCLOSURE OF INVENTION

The system of the present invention relates to an improved approach for dispensing individual segments of sheet material, such as paper toweling, from a roll of such material. The invention has particular application to the dispensing of individual paper towels from a roll of paper towels. The invention is characterized by its simplicity, reliability, and relatively low cost of manufacture.

The system of the invention includes a dispenser housing defining an interior and an opening in communication with the interior.

A roll of sheet material having side edges is positionable in the dispenser housing interior. The sheet material has a plurality of perforated tear lines dividing the sheet material into a plurality of sheet material segments including an end-most segment having a terminal end.

The roll of sheet material has a principal axis, i.e. the axis of rotation, and the perforated tear lines are parallel to one another and extend across the sheet material between the side edges. At least a portion of each tear line is disposed at an angle to the principal axis whereby the terminal end of the end-most segment of the sheet material will incrementally emerge from the opening in the housing during dispensing of the sheet material from the roll.

Nip defining means is operatively associated with the housing. The nip defining means defines a nip through which the sheet material passes when a pulling force is applied to the end-most segment and exerts a drag force on the sheet material in opposition to the pulling force whereby the end-most segment will tear along the tear line separating the end-most segment from the adjacent segment and present a portion of the adjacent segment externally of the housing for manual grasping by an individual.

The nip defining means includes two rollers. According to a preferred embodiment of the invention, at least one of the nip rollers has a deformable surface, the nip rollers being in tight engagement and the deformable surface of said at least one nip roller being deformed by another of the nip rollers to a degree sufficient to impede rotational movement of the nip rollers and to create a drag force on the sheet material passing therethrough.

In another preferred embodiment of the invention, means is provided to impede rotational movement of the nip rollers, said means being in the form of a frictional brake in operative association with at least one of the nip rollers.

Other features, advantages, and objects of the present invention will become apparent with reference to the following description and accompanying drawings.

MODES FOR CARRYING OUT THE INVENTION

Figure 1:
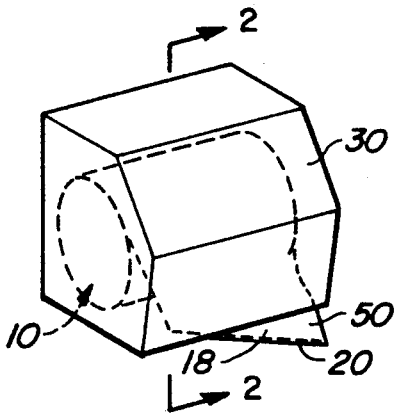
FIG. 1 is a frontal perspective view of a paper towel dispenser housing with the terminal end of a paper towel projecting therefrom.
Figure 2:
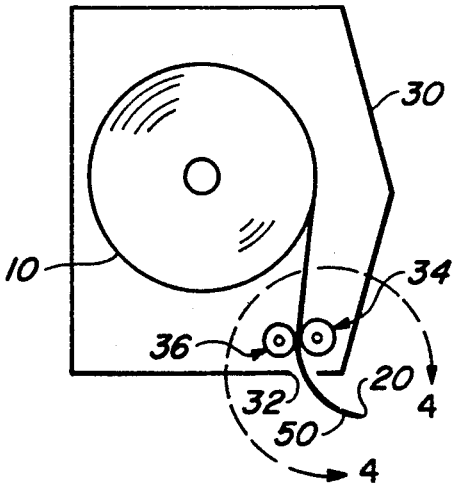
FIG. 2 is a diagrammatic, cross-sectional view as taken along line 2—2 of FIG. 1.
Figure 3:
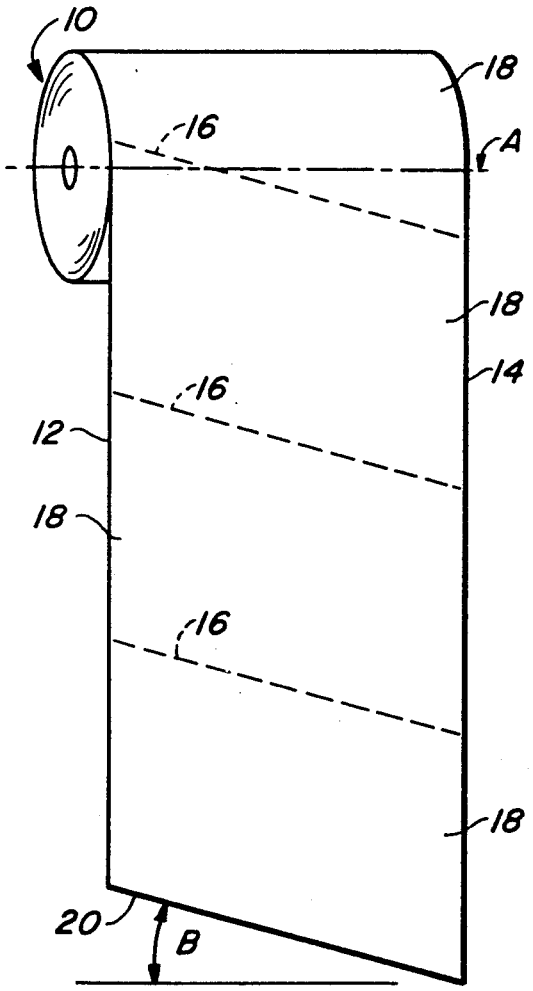
FIG. 3 is a frontal perspective view of a roll of toweling illustrating one form of perforated tear lines which are employed in the system of the present invention.
Figure 4:
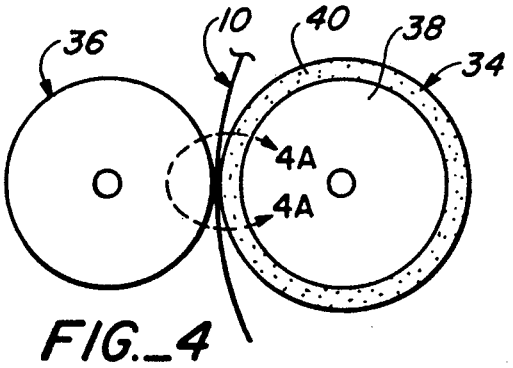
FIG. 4 is an enlarged side view of nip rollers employed in a preferred form of the invention with toweling passing through the nip formed by the rollers.
Figure 4A:
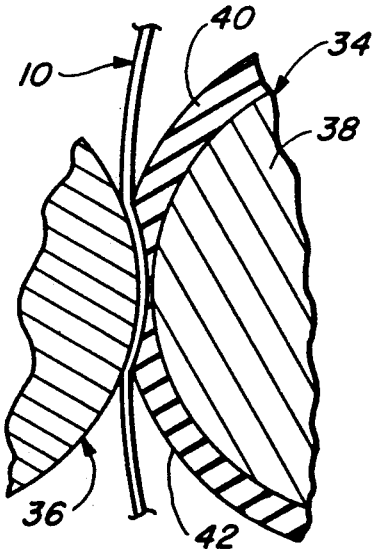
FIG. 4A is a greatly enlarged side view of the segment denoted by line 4A—4A in FIG. 4.
Figure 5:
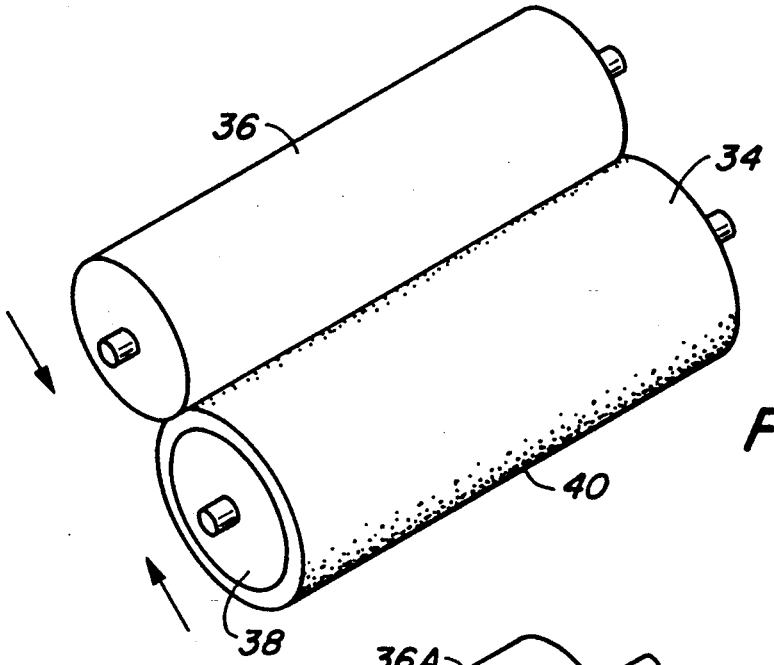
FIG. 5 is a perspective view of the rollers shown in FIGS. 4 and 4A.

Referring now to FIGS. 1–5, paper toweling constructed in accordance with the teachings of the present invention is generally designated by reference numeral 10 and is wound into a roll. The toweling has side edges 12, 14 and a plurality of perforated tear lines 16 dividing the toweling into a plurality of towels or sheet material segments 18. The toweling includes an end-most segment having a terminal end 20.

Figure 7:
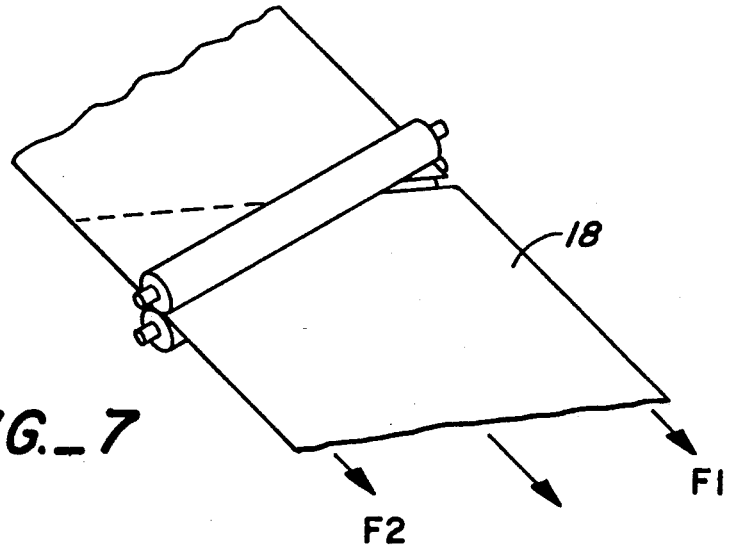
FIG. 7 is a perspective diagrammatic view of the paper toweling passing through nip rollers.

Roll of toweling 10 has a principal axis A (FIG. 3), which is the axis of rotation of said roll. In the toweling embodiment of FIGS. 1, 3 and 7, perforated tear lines 16 are straight, parallel to one another, and extend across the toweling between the side edges at an acute angle B relative to the principal axis. Preferably, the acute angle B is in the range of from about five degrees to about thirty degrees, and even more preferably, between about fifteen degrees and about twenty degrees.

Roll of toweling 10 is positionable within the interior of a dispenser housing 30 defining an opening 32 in communication with the interior. The toweling may be supported at its ends by any suitable support arrangement commonly found in paper towel dispensers and the like. Alternatively, of course, the roll of toweling 10 may simply rest elsewhere in the housing such as on the bottom thereof.

Nip defining means is operatively associated with the housing 30 defining a nip through which the toweling passes when a pulling force is applied to the end-most towel. It is an important aspect of this invention that the nip defining means exerts a drag force on the toweling in opposition to the pulling force exerted thereon whereby the end-most towel will incrementally tear along the tear lines separating the end-most towel from an adjacent towel and present a portion of the adjacent towel externally of the housing for manually grasping by an individual before complete severance takes place. Complete severance will not occur until the towel being pulled passes through the nips.

In FIGS. 1–5, the nip defining means is in the form of nip rollers 34, 36 mounted for rotational movement within the housing adjacent to opening 32. Nip roller 34 has a central core 38 of relatively inflexible material, such as wood, plastic, or metal, and an outer cylinder 40 of resilient material such as rubber, soft plastic, or the like.

Relative positioning of the nip rollers 34, 36 is such that the outer surface 42 of resilient material cylinder 40 is deformed by and is in intimate engagement with a portion of the outer surface of nip roller 36. That is, more than point-to-point engagement exist between the nip rollers. Deformation of nip roller 34 at the outer surface 42 will impede rotational movement of the nip rollers and create a drag force on toweling passing between the nip formed thereby. This is a result of pressing the rollers together by exerting opposed forces on the rollers as depicted by the two arrows of FIG. 5.

In FIGS. 1, 2, 4, and 4A, a portion 50 of the end-most towel 18, said portion 50 being defined by terminal end 20 and the perforated line 16 separating the end-most towel 18 from the adjacent towel 18, has passed through the nip defined by nip rollers 34, 36 and projects outwardly of dispenser housing 30 through opening 32 so that the portion 50 may be manually grasped by a user and pulled. It is to be noted that the entire terminal end 20 of the end-most towel 18 does not emerge from the opening 32 at once, this due to the above-described angular orientation of the perforated tear lines. The user pulls portion 50 which results in the end-most towel 18 rotating nip rollers 34, 36 as the end-most towel continues its passage therebetween.

When the next perforated tear line 16 (the tear line 16 located between the end-most towel and the adjacent towel) reaches the nip rollers, the opposed forces caused by user pull and the drag caused by the nip rollers will result in that perforated line tearing as it passes through the nip. Such tearing will not be complete until the last of the towel grasped by the user exits the nip and normally will occur at the location along the perforated tear line emerging from the nip. This is shown in somewhat diagrammatic fashion in FIG. 7. The user initiates toweling movement by exerting a force F1 at portion 50. After the terminal end has completely exited the dispenser, the user may grasp the other edge and also apply force F2.

The end-most towel will continue to cause rotation of the nip rollers until the end-most towel is completely separated from the adjoining towel. This occurs when the perforated tear line between the end-most towel and the adjoining towel substantially completely exits the nip. By the time complete separation occurs, a portion 50 of the adjoining towel is presented to the user so that the dispensing operation may again be initiated. The level or degree of drag and pull forces required to separate the towels will vary, depending upon such factors as web strength and size as well as the number and length of perforations, and can be readily arrived at in a particular instance without undue experimentation.

Figure 6:
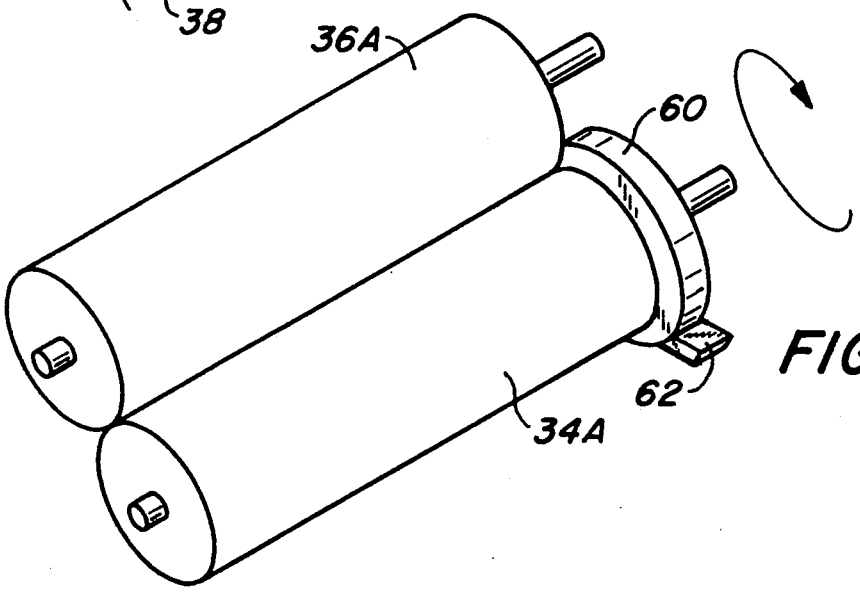
FIG. 6 is a view similar to FIG. 5 but showing an alternative embodiment of the invention employing brake arrangement to exert drag on the nip rollers to impede rotation thereof.

FIG. 6 shows an alterative embodiment of the invention wherein two nip rollers 34A and 36A form a nip. In this embodiment, the outer surfaces of both nip rollers are relatively firm. A drag force (as represented by the arrow) is applied by a brake disk 60 which rotates with roller 34A and a fixed brake element 62 which frictionally engages the peripheral surface of disk 60 to impede rotation of the disk and roller 34A. Suitable means (not shown) may be used to adjust pressure between disk 60 and element 62.

Figure 8:
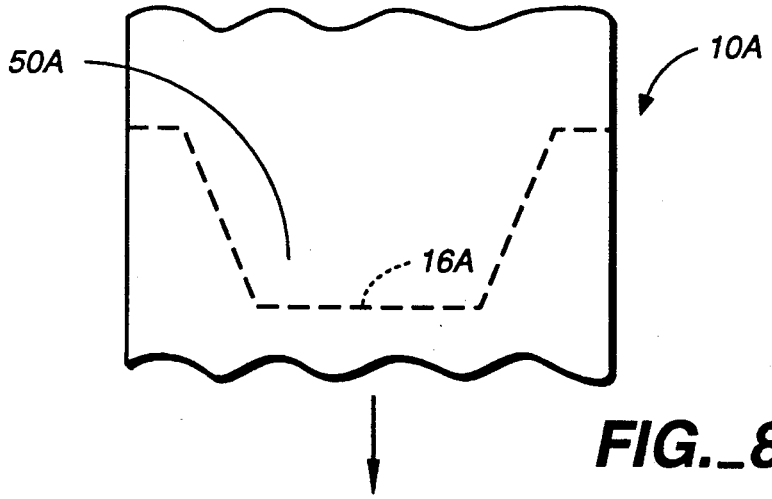
FIGS. 8–10 are fragmentary plan views illustrating three different alternative embodiments of perforated tear lines which may be employed when practicing the teachings of the present invention.
Figure 9:
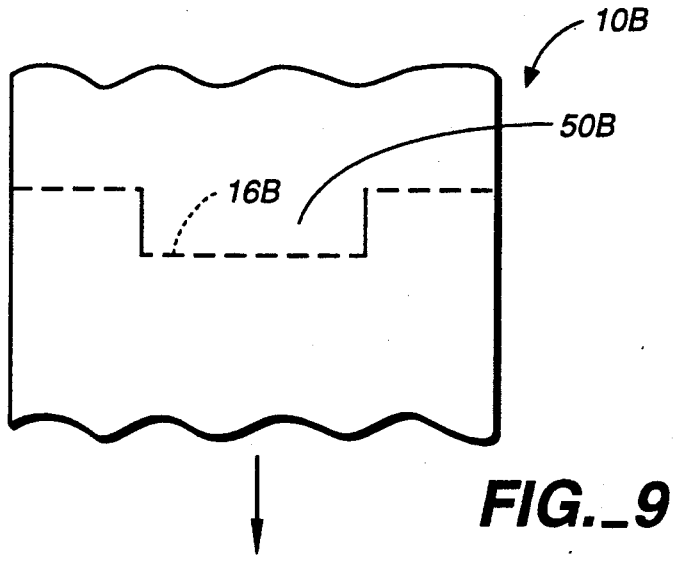
Figure 10:
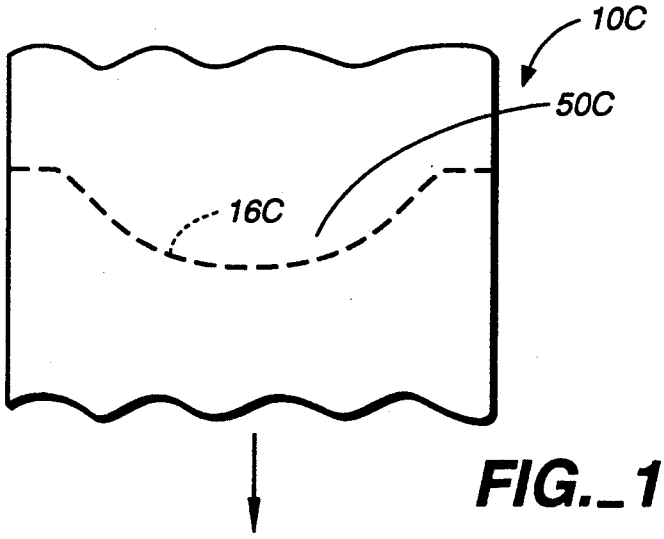

FIGS. 8–10 illustrate alternative perforated tear line configurations which may be used to practice the teachings of the present invention. In FIG. 8 tear line 16A of toweling 10A is configured to present a portion 50A to the user for grasping. The sides of portion 50A are defined by inclined perforation lines.

In FIG. 9, a tear line 16B of toweling 10B is configured to present a squared-off central portion 50B to the user so that the towel may be pulled. The sides of the central portion are defined by continuous slits. And in FIG. 10, tear line 16C of toweling 10C presents a curved central portion 50C to the user.

It will be appreciated that approaches other than those specifically disclosed may be adopted when carrying out the teachings of the present invention. For example, tear line configurations other than those specifically disclosed may be employed to present a manually graspable portion of a towel to the user. Also, means other than those specifically shown may be utilized to impede rotation of the nip rolls and exert a drag force on the toweling.

We claim:

1. A method of separating individual segments from a web of sheet material divided into segments by a plurality of perforated tear lines, said perforated tear lines being spaced from one another and extending across the width of said web, and said segments including an end-most segment, said method comprising the steps of:

pulling said end-most segment by applying a pulling force on said end-most segment in a predetermined direction;

during said pulling step, transporting said end-most segment through a nip defined by nip rollers;

pressing said rollers together and deforming at least one of the nip roller rollers to create a drag force on said end-most segment with said rollers as said end-most segment passes through said nip, said drag force being opposed to said pulling force;

utilizing said opposed pulling and drag forces to tear said web of sheet material along the perforated tear line separating the end-most segment from an adjacent segment as said end-most segment is transported through said nip; and completing the tearing of said perforated tear line separating the end-most segment from said adjacent segment after a portion of the adjacent segment has passed through said nip.

2. A dispenser for dispensing sheet material from a roll of sheet material having a terminal end and side edges, said sheet material additionally having a plurality of perforated tear lines dividing said sheet material into a plurality of sheet material segments including an end-most segment partially defined by said terminal end, said roll having a principal axis and said perforated tear lines being parallel to each other and extending across the sheet material between said side edges with at least a portion of said tear line disposed at an angle to said principal axis, said dispenser including:

a housing defining an interior for accommodating said roll of sheet material and an opening in communication with said interior, said opening accommodating the sheet material terminal end whereby said terminal end may be grasped and a pulling force applied thereto by a user to rotate said roll and remove sheet material therefrom; and nip defining means associated with said housing defining a nip through which said sheet material passes when a pulling force is applied to the end-most segment of said sheet material adjacent to said terminal end, said nip defining means exerting a drag force on said sheet material in opposition to said pulling force whereby the end-most segment will tear along the tear line separating the end-most segment from an adjacent segment as said tear line passes through said nip defining means, said nip defining means being so positioned relative to said opening in said housing as to present a portion of said adjacent segment externally of said housing for subsequent manual grasping by a user when said end-most segment totally separates from said adjacent segment, said nip defining means including nip rollers and means to impede rotational movement of said nip rollers, and said means to impede rotational movement of said nip rollers comprising frictional brake means engaging at least one of said nip rollers to exert frictional braking forces thereon.

3. A method of separating individual segments from a web of sheet material divided into segments by a plurality of perforated tear lines, said perforated tear lines being spaced from one another and extending across the width of said web, and said segments including an end-most segment, said method comprising the steps of:

pulling said end-most segment by applying a pulling force on said end-most segment in a predetermined direction;

during said pulling step, transporting said end-most segment through a nip defined by nip rollers;

applying a frictional braking force to at least one of said nip rollers by frictionally engaging said at least one nip roller with a stationary brake to create a drag force;

exerting said drag force on said end-most segment with said rollers as said end-most segment passes through said nip, said drag force being opposed to said pulling force;

utilizing said opposed pulling and drag forces to tear said web of sheet material along the perforated tear line separating the end-most segment from an adjacent segment as said end-most segment is transported through said nip; and completing the tearing of said perforated tear line separating the end-most segment from said adjacent segment after a portion of the adjacent segment has passed through said nip.

4. In combination:

a dispenser housing defining an interior and an opening in communication with said interior;

a roll of sheet material having side edges positionable in said dispenser housing interior, said sheet material having a plurality of perforated tear lines dividing said sheet material into a plurality of sheet material segments including an end-most segment having a terminal end, said roll of sheet material having a principal axis and said perforated tear lines being parallel to each other and extending across the sheet material between said side edges, with at least a portion of each tear line disposed at an angle to said principal axis whereby the terminal end of the end-most segment of said sheet material will incrementally emerge from said opening in said housing during dispensing of said sheet material from said roll;

nip defining means operatively associated with said housing defining a nip through which said sheet material passes when a pulling force is applied to said end-most segment and exerting a drag force on said sheet material in opposition to said pulling force whereby the end-most segment will tear along the tear line separating the end-most segment from an adjacent segment and present a portion of said adjacent segment externally of said housing for subsequent manual grasping by an individual, said nip defining means including nip rollers, at least one of said nip rollers having a deformable surface, said nip rollers being in tight engagement and said deformable surface of said at least one nip roller being deformed by another of said nip rollers to a degree sufficient to impede rotational movement of said nip rollers and to create said drag force.

5. A dispenser for dispensing sheet material from a roll of sheet material having a terminal end and side edges, said sheet material additionally having a plurality of perforated tear lines dividing said sheet material into a plurality of sheet material segments including an end-most segment partially defined by said terminal end, said roll having a principal axis and said perforated tear lines being parallel to each other and extending across the sheet material between said side edges with at least a portion of said tear line disposed at an angle to said principal axis, said dispenser including:

a housing defining an interior for accommodating said roll of sheet material and an opening in communication with said interior, said opening accommodating the sheet material terminal end whereby said terminal end may be grasped and a pulling force applied thereto by a user to rotate said roll and remove sheet material therefrom; and nip defining means associated with said housing defining a nip through which said sheet material passes when a pulling force is applied to the end-most segment of said sheet material adjacent to said terminal end, said nip defining means exerting a drag force on said sheet material in opposition to said pulling force whereby the end-most segment will tear along the tear line separating the end-most segment from an adjacent segment as said tear line passes through said nip defining means, said nip defining means being so positioned relative to said opening in said housing as to present a portion of said adjacent segment externally of said housing for subsequent manual grasping by a user when said end-most segment totally separates from said adjacent segment, said nip defining means including nip rollers, at least one of said nip rollers having a deformable surface, said nip rollers being in tight engagement and said deformable surface of said at least one nip roller being deformed by another of said nip rollers to a degree sufficient to impede rotational movement of said nip rollers and to create said drag force.

6. A roll of sheet material having side edges positionable in the interior of a dispenser housing, said housing defining an opening in communication with said interior, and said sheet material cooperable with nip defining means operatively associated with said housing and having a plurality of perforated tear lines dividing said sheet material into a plurality of sheet material segments including an end-most segment having a terminal end, said roll of sheet material having a principal axis and said perforated tear lines being parallel to each other and extending across the sheet material between said side edges, with at least a portion of each tear line disposed at an angle to said principal axis whereby the terminal end of the end-most segment of said sheet material will emerge incrementally from said opening in said housing during dispensing of said sheet material from said roll when a pulling force is applied to said end-most segment, said sheet material being so constructed that a drag force exerted by said nip defining means on said sheet material in opposition to said pulling force will result in the end-most segment being torn along the tear line separating the end-most segment from an adjacent segment and present a portion of said adjacent segment externally of said housing for subsequent manual grasping by an individual, said sheet material comprising paper toweling, and said perforated tear lines being substantially straight and extending across the paper toweling at an acute angle relative to said principal axis.

7. The roll according to claim 6 wherein said acute angle is in the range of from about 5 degrees to about 30 degrees.

8. The roll according to claim 7 wherein said acute angle is between about 15 degrees and about 20 degrees.

9. In combination:

a dispenser housing defining an interior and an opening in communication with said interior;

a roll of sheet material having side edges positionable in said dispenser housing interior, said sheet material having a plurality of perforated tear lines dividing said sheet material into a plurality of sheet material segments including an end-most segment having a terminal end, said roll of sheet material having a principal axis and said perforated tear lines being parallel to each other and extending across the sheet material between said side edges, with at least a portion of each tear line disposed at an angle to said principal axis whereby the terminal end of the end-most segment of said sheet material will incrementally emerge from said opening in said housing during dispensing of said sheet material from said roll;

nip defining means operatively associated with said housing defining a nip through which said sheet material passes when a pulling force is applied to said end-most segment and exerting a drag force on said sheet material in opposition to said pulling force whereby the end-most segment will tear along the tear line separating the end-most segment from an adjacent segment and present a portion of said adjacent segment externally of said housing for subsequent manual grasping by an individual, said nip defining means including nip rollers and means to impede rotational movement of said rollers.

10. The combination according to claim 9 wherein said means to impede rotational movement of said nip rollers comprises frictional brake means in operative association with at least one of said nip rollers to apply frictional braking forces thereto.

11. In combination:

a dispenser housing defining an interior and an opening in communication with said interior;

a roll of sheet material having side edges positionable in said dispenser housing interior, said sheet material having a plurality of perforated tear lines dividing said sheet material into a plurality of sheet material segments including an end-most segment having a terminal end, said roll of sheet material having a principal axis and said perforated tear lines being parallel to each other and extending across the sheet material between said side edges, with at least a portion of each tear line disposed at an angle to said principal axis whereby the terminal end of the end-most segment of said sheet material will incrementally emerge from said opening in said housing during dispensing of said sheet material from said roll;

nip defining means operatively associated with said housing defining a nip through which said sheet material passes when a pulling force is applied to said end-most segment and exerting a drag force on said sheet material in opposition to said pulling force whereby the end-most segment will tear along the tear line separating the end-most segment from an adjacent segment and present a portion of said adjacent segment externally of said housing for subsequent manual grasping by an individual, said roll of sheet material comprising a roll of paper toweling, and said perforated tear lines being substantially straight and extending across the paper toweling at an acute angle relative to said principal axis.

12. The combination according to claim 11 wherein said acute angle is in the range of from about 5 degrees to about 30 degrees.

13. The combination according to claim 12 wherein said acute angle is between about 15 degrees and about 20 degrees.

* * * * *